US006115981A

United States Patent [19]

Counihan

[11] Patent Number: 6,115,981

[45] Date of Patent: Sep. 12, 2000

[54] RESILIENT FLOORING

[76] Inventor: James Counihan, 50 Griffin Mill Rd., Piedmont, S.C. 29673

[21] Appl. No.: 09/211,275

[22] Filed: Dec. 14, 1998

[51] Int. Cl.[7] ..... E04F 15/22

[52] U.S. Cl. ..... 52/403.1; 52/480; 52/489.1; 52/718.06

[58] Field of Search ..... 52/403.1, 480, 52/718.06, 481.1, 481.2, 710, 370, 489.1

[56] References Cited

U.S. PATENT DOCUMENTS

| | | | |
|---|---|---|---|
| 1,350,349 | 8/1920 | Walther | 52/403.1 |
| 3,271,916 | 9/1966 | Omholt | 52/403.1 |
| 3,553,919 | 1/1971 | Omholt | 52/480 |
| 3,562,990 | 2/1971 | Boettcher | 52/480 |
| 3,619,963 | 11/1971 | Omholt | 52/480 |
| 3,786,608 | 1/1974 | Boettcher | 52/480 |
| 4,589,243 | 5/1986 | Abendroth | 52/403.1 |
| 4,856,250 | 8/1989 | Gronau et al. | 52/480 |
| 4,879,856 | 11/1989 | Jones | 52/403.1 |
| 5,369,927 | 12/1994 | Counihan | 52/403.1 |
| 5,497,590 | 3/1996 | Counihan . | |
| 5,647,183 | 7/1997 | Counihan . | |
| 5,778,621 | 7/1998 | Randjelovic | 52/403.1 |

*Primary Examiner*—Beth A. Stephan
*Assistant Examiner*—Dennis L. Dorsey
*Attorney, Agent, or Firm*—Henry S. Jaudon; Cort Flint

[57] ABSTRACT

A sleeper system, used to attach covering flooring with a base floor. The improved arrangement comprises a metallic channel secured with the base floor. The channel comprises a horizontal base, spaced vertical and parallel sides, and an inwardly directed tab formed with the upper end of each of the sides. The tabs extending along a plane which is parallel with the plane of the base of the channel. A resilient pad is located within and extends along the channel. A wooden stud having an upper surface of a first width, a lower surface of a lesser second width and a pair of side surfaces with inwardly extending portions connecting with the lower surface is provided for placement within the channel. The stud has a plurality of attachment clips secured with each of its side walls. Each attachment clip includes a longitudinal extension having a portion spaced laterally from each side wall. An outwardly directed hook is formed at the lower end of each attachment clip. Assembly of the sleeper provides securing the channel with the base floor. Positioning the stud over the channel with the hooks of opposed attachment clips positioned inwardly of and in engagement with inner ends of the channel tabs. Downward pressure on the stud causes lower ends of the attachment clip to flex inwardly while the channel sides are flexed outwardly allowing the stud to enter and be secured within the channel.

19 Claims, 3 Drawing Sheets

RESILIENT FLOORING

BACKGROUND OF THE INVENTION

The instant invention is directed to a sleeper for use with a resilient flooring system and the resilient flooring system utilizing the novel sleeper.

Resilient flooring utilizing sleepers including resilient padding has long been known in the flooring industry. One such system is disclosed in U.S. Pat. No. 5,369,927 in which a plurality of spaced floor clips and a plurality of spaced resilient pads act to support and retain the stud. This arrangement has the drawback of being extremely time consuming because of the numerous individual members needed for assembly. Particularly cumbersome is the act of engaging the shoulders of the stud beneath the shoulders of the floor clip. Additionally, positioning the clips across the floor requires precise alignment. Also, U.S. Pat. No. 4,856,250 utilizes a plurality of elongated and staggered guide ways to receive and retain the stud. Here the stud is slipped longitudinally into the guide-way and cumbersome spring members act to urge them into position. Guide-way shoulders maintain the stud within the guide-way and limit its vertical movement. Again positioning the studs within the guide-way and positioning the stud and guide-way is a time consuming tedious process.

The instant invention has, for its object, a sleeper system which can be laid out over the base floor in a quick easy manner.

Another object of the invention is a sleeper system in which the stud may be easily positioned within the guide channel.

Another object of the invention is a sleeper system in which the stud is restrained in the guide-way against upward vertical movement while having limited downward vertical movement.

Another object of the invention is a resilient flooring system which may be constructed with uniform resiliency throughout.

SUMMARY OF THE INVENTION

A sleeper for use with a resilient flooring system in which a plurality of spaced parallel sleepers support a sub-floor and a finished floor for resilient vertical movement. The sleeper comprises an elongated base clip adapted to be secured with a base floor. The base clip includes a base, a pair of laterally spaced vertically extending sides and an inwardly and substantially horizontally extending shoulder formed at an end of each side. An elongated cushion is positioned within and is supported by the base clip between the side walls.

An elongated shaped stud, having an upper surface of a width substantially corresponding to a distance separating inner ends of the shoulders, a lower surface of less width than the upper surface and a pair of side walls extending between outer edges of the upper and lower surfaces, is adapted to be positioned within the base clip. The stud has a plurality of engaging clips secured along each of its sides. Each engaging clip includes an upper end, a lower end, and a longitudinal extension secured with the stud perpendicularly of its upper surface. A portion of the longitudinal portion is in engagement with at least a portion of the side surface while the lower end thereof forms an outwardly directed wedge.

This arrangement provides that the stud may be positioned with the base clip once the base clip is secured on the base floor with the cushion positioned therein. The stud is positioned over the base clip with the wedge, at each side, positioned in engagement with and between the ends of the shoulders. Downward pressure on the stud causes the lower ends of the longitudinal extensions to flex inwardly and the upper ends of the side walls to flex outwardly allowing the stud to move into position within the base clip. Once within the base clip, the wedges engage beneath the shoulders limiting upward vertical movement of the stud.

The base clip may extend across the base floor as a single unit or it may comprise a plurality of spaced clip units arranged across the base floor.

Each side of the stud is formed with a longitudinal section arranged perpendicularly of and engaging with the surface. A portion of each side is disposed at an acute angle relative to the upper and lower surface and engages with the lower surface. The engaging clips are secured with the upper side portions with the lower portion of their longitudinal extension spaced from the lower portion of the side walls. This structure allows inward flexing of the longitudinal portion.

The wedge of the engaging clip may comprise an upwardly directed hook or an outwardly directed shoulder with an inwardly directed lower extension. The upper portion of the engaging clip includes a shoulder extending over and engaging with the upper surface of the stud. The engaging clip may extend the length of the stud or it may be only 6" to 8" in length. The latter arrangement allows pairs of engaging clips to be arranged in opposed or staggered positions transverse of the stud along its length.

The engaging clips are preferably formed of eighteen gauge steel.

The sleeper cushion, which is about ½" thick, may be rectangularly shaped or it may be shaped with opposed upper shoulders. Either arrangement supports the stud along its entire length.

DESCRIPTION OF THE DRAWINGS

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
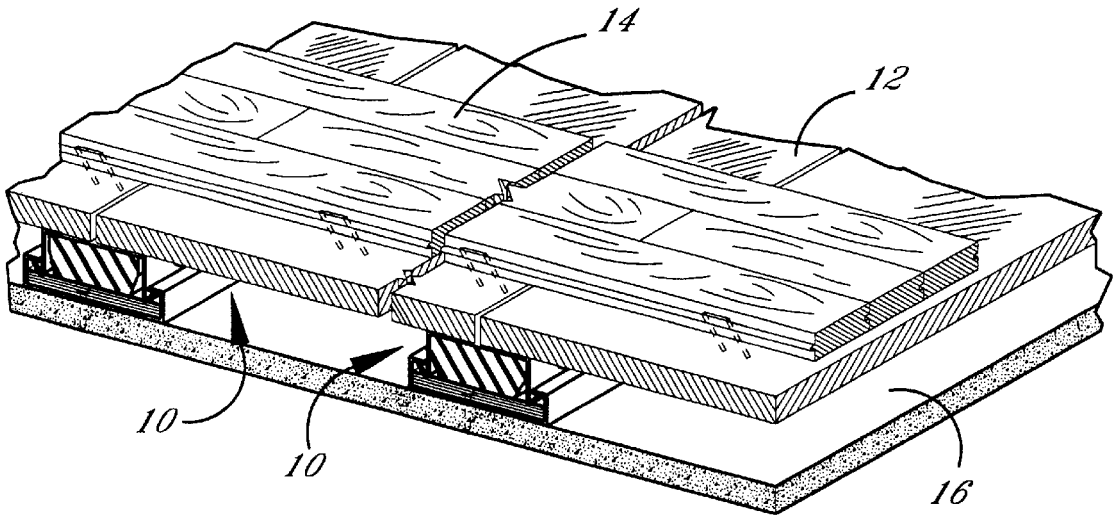
FIG. 1 is a sectional perspective view of a resilient flooring using the sleeper of the invention.
Figure 2:
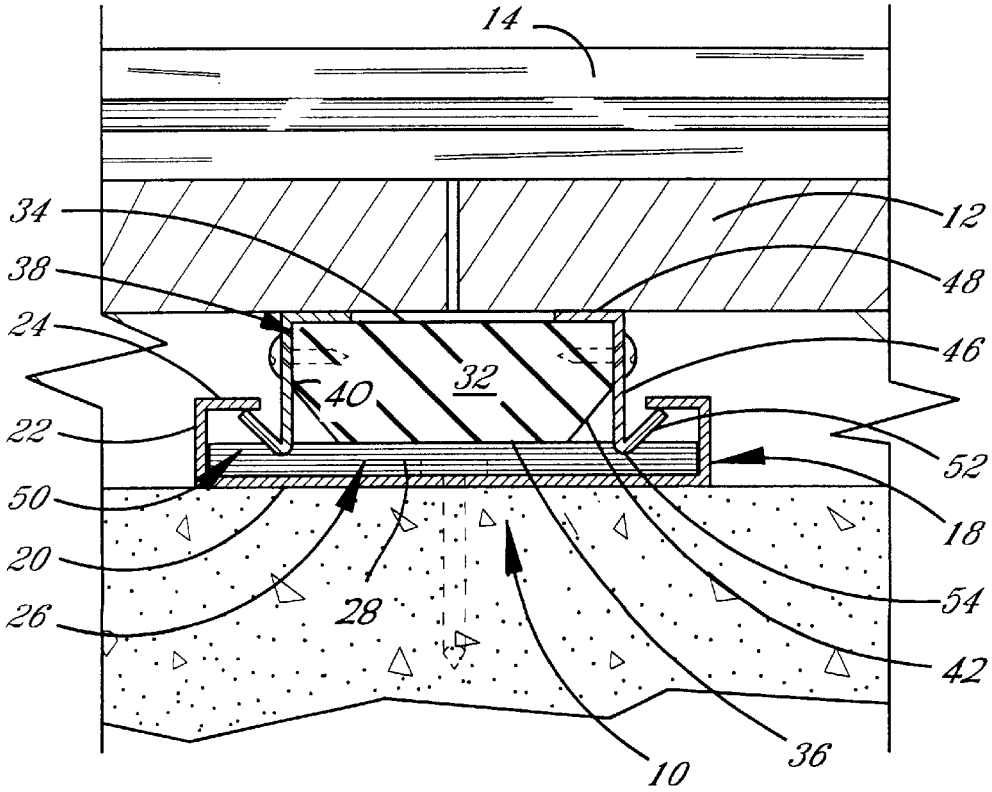
FIG. 2 is a sectional end view of the sleeper of the invention.
Figure 3:
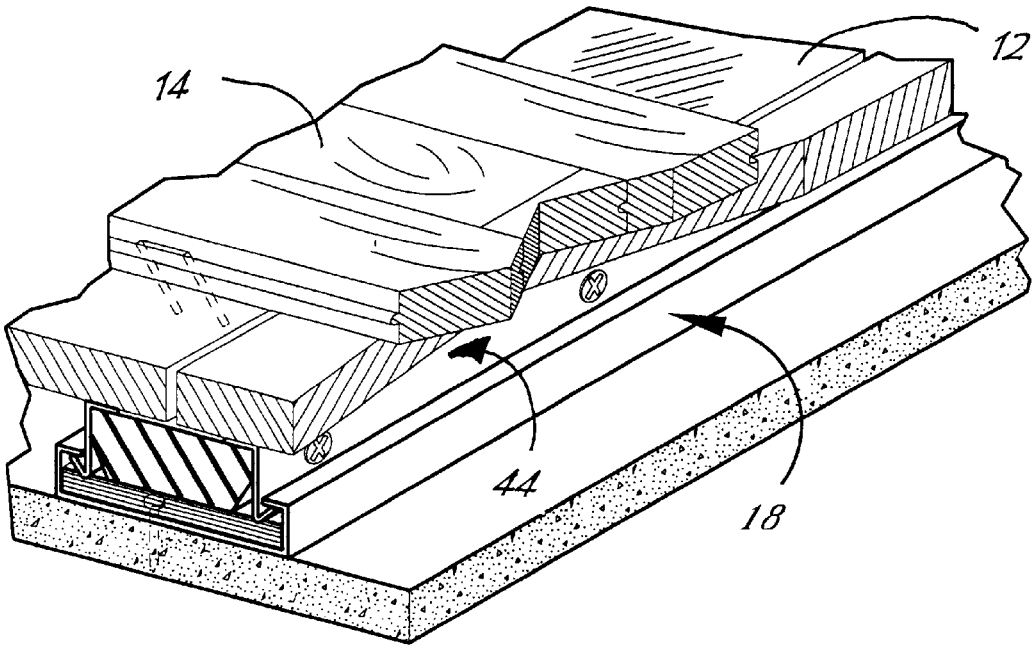
FIG. 3 is a sectional perspective view of a preferred embodiment of the base clip.
Figure 4:
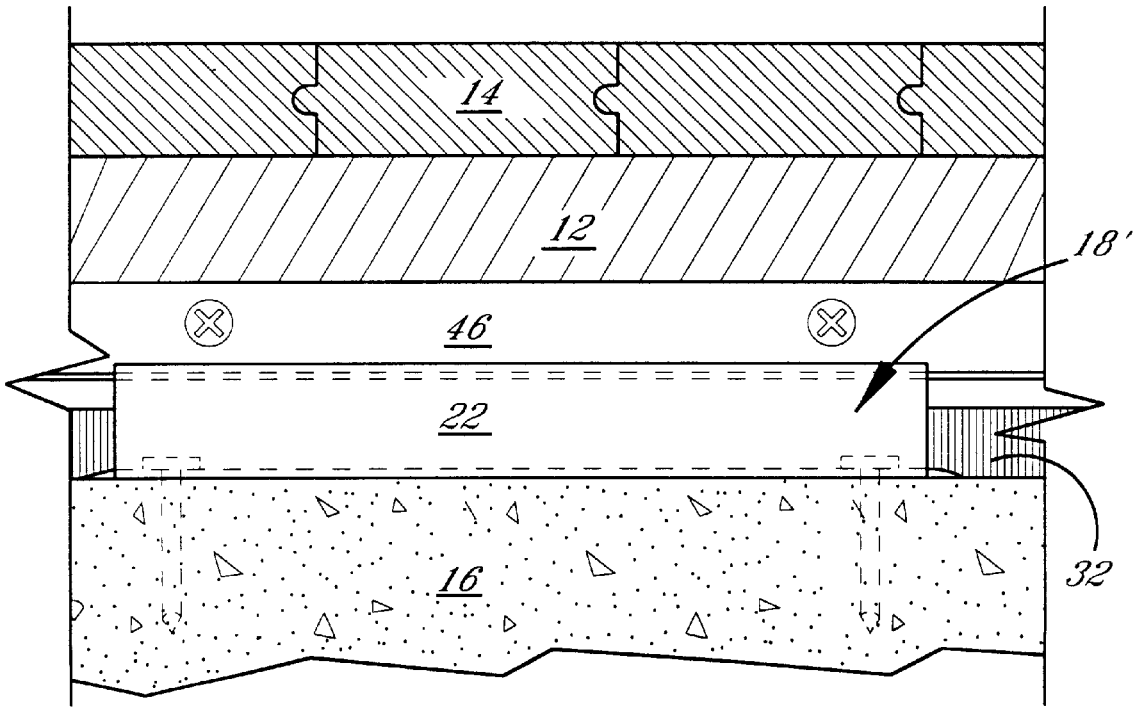
FIG. 4 is a sectional side view of the sleeper of the invention.

Turning now to the drawings where FIG. 1 shows a sectional view of the sleeper arrangement 10 of the invention supporting a sub-floor 12 and a finished floor 14 for limited vertical movement relative to a base floor 16. As best seen in FIGS. 2–4, each sleeper 10 is formed with a base clip 18 which is preferably formed of eighteen gauge steel. Other materials or different gauges may be used so long as the desired function is achieved.

Base clip 18 comprises a base 20, two side walls 22 formed at opposite ends and arranged perpendicular of the base. An inwardly extending shoulder 24 is formed at the upper end of side walls 22 with the inner ends thereof being spaced by about two inches. The base clip as described defines a channel 26.

Base clip 18 may comprise a unitary member which extends completely across the base floor as shown in FIG. 3 or it may be constructed at selected lengths down to about eight inches. The smaller units are arranged in spaced increments across the base floor 16 as shown in FIG. 4. In both arrangements, base clip 18 or 18' is secured to base floor 16 by nails, brads, screws, etc. along spaced longitudinal lines across the base floor as shown in FIG. 1.

A cushion 28 is supported in channel 26. The cushion is generally rectangularly shaped with its sides being spaced generally slightly less than the width of channel 26. The cushion is preferably formed of foam or rubber to be about one-half inch thick. Other resilient materials may be substituted for the rubber or foam.

Figure 5:
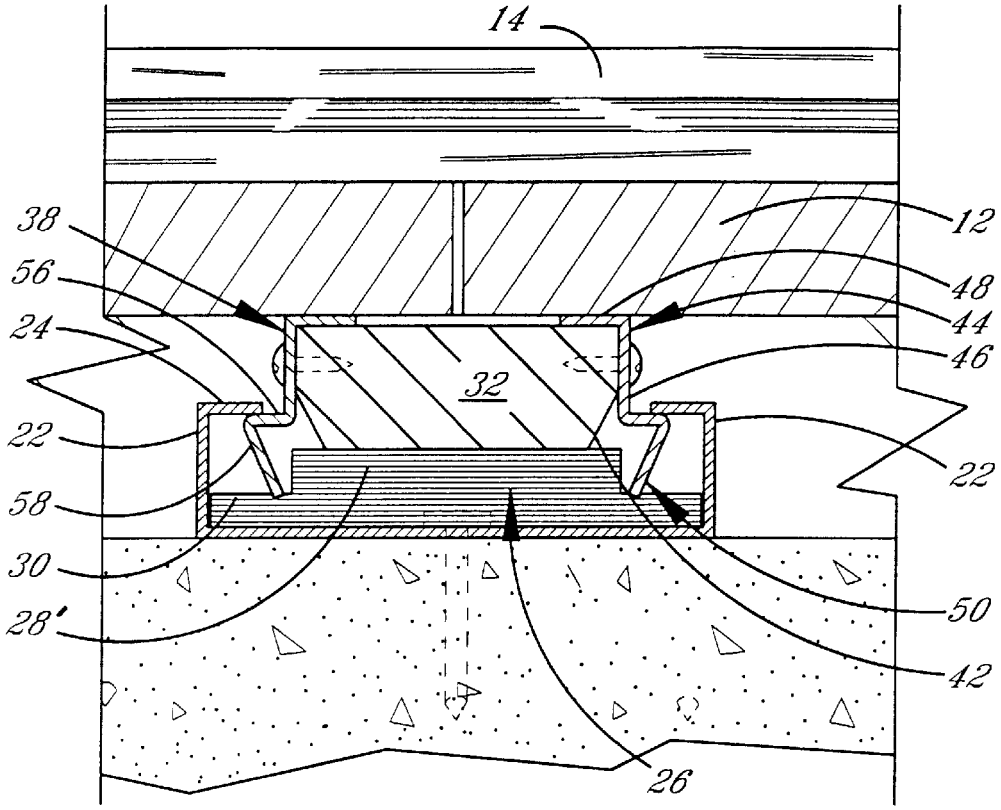
FIG. 5 is a sectional end view of a second embodiment of the sleeper of the invention; and, FIG. 6 is a sectional end view of the action between the base clip and the wedge clip during positioning of the stud within the channel of the base clip.

In certain instances, as illustrated in FIG. 5, it may be desirable to provide recessed shoulders 30 along upper edges of cushion 28' to accommodate the coupling structure of the engaging clips 44.

Stud 32, which is secured within channel 26, comprises an elongated wooden member having a top surface 34, a bottom surface 36, and side surfaces 38. Stud 32 may be formed as a single piece which extends across the base floor or it may comprise a plurality of elongated members arranged end to end across the base floor. The stud may be formed of plywood, wood, or fiber board. Preferably, the upper surface is two inches wide while the lower surface is about one and one-half inches wide.

Each side 38 includes an upper section 40 arranged perpendicular of top surface 34 and a lower section 42 arranged at an acute angle to lower surface 36. Preferably upper and lower sections 40, 42 are of equal height, however, this may vary slightly in either direction.

Engaging clips 44 are secured with sides 38 along the length of stud 32. Each clip may comprise a continuous piece or it may comprise individual units as small as six inches spaced at six to ten inch intervals in transverse or staggered relationship along the length of the stud. Nails, screws, brads or other equivalent means secure engaging clips 44 with sides 38.

Engaging clips 44 are formed of shaped eighteen gauge steel. Each engaging clip comprises a longitudinal section 46, an upper inwardly directed shoulder 48 and a lower wedge 50. Again, other materials or gauge metal may be used.

Wedge 50 of clips 44 may be in the form of an upwardly and outwardly directed hook 52 having a lower substantially pointed end 54 as shown in FIG. 2. Alternatively, wedge portion 50 may comprise an outwardly directed shoulder 56 and an inwardly and downwardly directed end portion 58 as shown in FIG. 5.

Another variation (not shown) of the wedge portion 50 could comprise stamped outwardly directed hook members formed a selected distance from the lower end.

Figure 6:
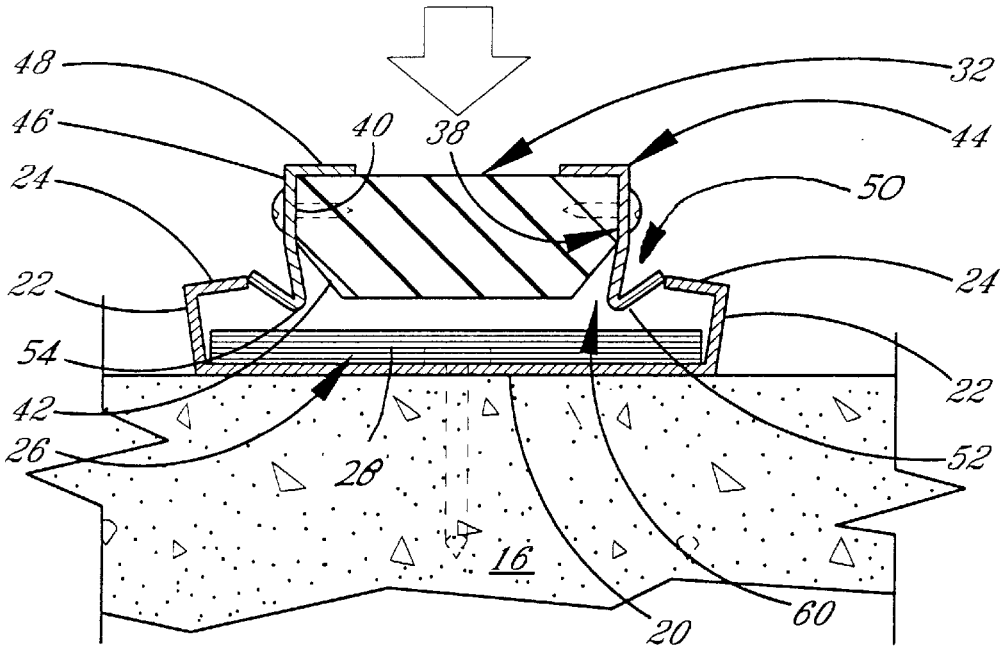

In practice, base clips 18 are arranged and secured in spaced parallel rows across base floor 16. Cushion 28 is positioned in channel 26 beneath shoulder 48 to extend along the length of each clip 18 and across the base floor. Stud 32, with engaging clips 44 secured along each side thereof, is positioned over channel 26 with wedges 50 positioned in engagement with the inner ends of shoulders 24. Downward pressure against the upper surface of stud 32 creates lateral pressure between wedges 50 and the ends of shoulders 24 causing lower portions of longitudinal sections 46 to flex inwardly into area 60 and side walls 22 of base clips 18 to flex outwardly, as shown in FIG. 6, allowing stud 32 to slip into position within channel 26. In position within the channel, stud 32 is now secured against upward vertical movement by the engagement between shoulders 24 and wedge 50 while a slight downward vertical movement is allowed by cushion 28.

The disclosed arrangement provides sleepers for accurate placement across the base floor while at the same time provides an arrangement which is easily and quickly assembled.

While a preferred embodiment of the invention has been described using specific terms, such description is for illustrative purposes only, and it is to be understood that changes and variations may be made without departing from the spirit or scope of the following claims.

What is claimed is:

1. A sleeper for use with a resilient flooring system in which a plurality of spaced parallel sleepers support a sub-floor and finished floor for resilient vertical movement, said sleeper comprising:

at least one elongated base clip adapted to be secured with a base floor, said base clip having a base, a pair of laterally spaced substantially vertically extending sides each having an inwardly substantially horizontally extending shoulder;

at least one cushion supported by said base clip between said sides;

at least one elongated stud having an upper surface of a width substantially corresponding to a distance separating lower ends of said clip sides, a lower surface of less width than said upper surface and a pair of sides extending between outer edges of said upper and lower surfaces;

said stud includes engaging clips arranged along each side thereof, each said engaging clip having an upper end, a lower end, and a longitudinal extension, said longitudinal extension extending perpendicularly of said upper surface in secured engagement with at least a portion of said side surface, said lower end of each said engaging clip forming an outwardly directed wedge; whereby, said base clip may be secured with said base floor with said cushion positioned therein and said stud may be secured within said base clip by causing opposed of said wedges to engage with ends of said shoulders causing relative displacement therebetween allowing said stud to pass between said shoulder ends to be positioned and secured within said base clip as said wedges engage beneath said shoulders limiting upward vertical movement of said stud.

2. The sleeper of claim 1 wherein said base clip extends across said base floor.

3. The sleeper of claim 1 wherein said base clip comprises a plurality of spaced clip units arranged across said base floor.

4. The sleeper of claim 1 wherein each said side of said stud has a vertical section engaging with said upper end of said engaging clip.

5. The sleeper of claim 1 wherein at least a portion of each said side of said stud is disposed at an acute angle relative to said upper and lower services of said stud, said portion engaging with said lower surface.

6. The sleeper of claim 5 wherein a lower portion of said longitudinal extension of each said engaging clip is spaced from said side of said stud, said space allowing inward flexing of said lower portion.

7. The sleeper of claim 1 wherein said wedge comprises an upwardly directed hook.

8. The sleeper of claim 1 wherein said wedge comprises an outwardly directed shoulder with an inwardly and downwardly directed extension.

9. The sleeper of claim 1 wherein each said engaging clip includes an upper arm extending over and engaging with said upper surface of said stud.

10. The sleeper of claim 1 wherein said engaging clips are arranged as pairs in opposed positions transverse of said stud.

11. The sleeper of claim 1 wherein each engaging clip is formed of eighteen gauge steel.

12. The sleeper of claim 1 wherein said engaging clip and said stud are substantially of equal length.

13. The sleeper of claim 1 wherein said stud comprises a shaped elongated wooden member.

14. The sleeper of claim 1 wherein said engaging clips are secured with said side walls by one of braids, nails, and screws.

15. The sleeper of claim 1 wherein said cushion is rectangularly shaped.

16. The sleeper of claim 1 wherein said cushion supports said stud along its entire length.

17. The sleeper of claim 1 wherein said cushion includes side walls having a shoulder portion.

18. A sleeper system used to attach covering flooring with a base floor, said sleeper system including a plurality of transversely spaced rows of sleepers arranged along parallel axes across said base floor with said covering flooring extending transversely of and secured with each said sleeper of said sleeper system, the improvement comprising:

metallic channels secured with said base floor each said channel having a horizontal base, spaced substantially vertical and parallel sides, and inwardly directed tabs formed with upper ends of each of said sides forming a channel opening, said tabs extending along a plane substantially parallel with the plane of said base;

resilient padding located within and extending along each said channel;

a wooden stud located partially within each said channel and extending across said base floor, each said stud having an upper surface of a first width, a lower surface of a lesser second width and a pair of side surfaces including inwardly extending portions connecting with said lower surface;

a plurality of attachment clips each comprising a longitudinal extension having an outwardly directed wedge formed at a first end and an inwardly directed shoulder at a second end, said attachment clips being secured with each said stud with said first end of said longitudinal extensions being spaced laterally from said lower side surfaces; whereby, said sleeper system is assembled by securing each said channel with said base floor, positioning said studs above respective of said channel openings with at least a portion of said wedges located inwardly of and in contact with inner ends of said tabs, by applying downward pressure against said upper surface of said studs causing said channel sides to flex outwardly and said first ends of said attachment clips to flex inwardly allowing said studs to enter and be secured within said channels.

19. A sleeper system used to attach covering flooring with a base floor, said sleeper system including a plurality of transversely spaced rows of sleepers arranged along parallel axes across the base floor with said covering flooring extending transversely of and secured with each said sleeper of said sleeper system, the improvement comprising:

a plurality of base clips secured with said base floor forming a plurality of channels, each said channel having spaced substantially vertical and resilient sides with an inwardly directed tab at the upper end of each said side forming an upper channel opening between said tabs;

resilient padding located within each said channel;

a wooden stud located partially within each said channel and extending across said base floor, each said stud having an upper surface of a first width, a lower surface of a lesser second width and a pair of side surfaces interconnecting said upper and lower surfaces;

attachment clips connected with each of said side surfaces, each said attachment clip comprising a longitudinal extension having an outwardly directed wedge formed at a first end with second ends of said longitudinal extensions being secured with respective of said sides of said studs with said first ends being spaced laterally from said lower surfaces; whereby, each said sleeper of said sleeper system is assembled with said base floor by positioning a selected of said studs above a respective of said channel openings with a portion of said wedges located inwardly of an in contact with inner ends of said tabs, by applying downward pressure against said upper surface of said stud causing relative movement between said channel sides and said first ends of said attachment clips allowing said stud to enter into and be secured within said channel.

* * * * *